US006476363B1

(12) United States Patent
Authier et al.

(10) Patent No.: US 6,476,363 B1
(45) Date of Patent: Nov. 5, 2002

(54) RESISTIVE WATER SENSOR FOR HOT TUB SPA HEATING ELEMENT

(75) Inventors: Michel Authier, St- Augustin; Benoit Laflamme; Christian Brochu, both of Quebec, all of (CA)

(73) Assignee: Gecko Electronique, Inc., Quebec (CA)

( * ) Notice: Subject to any disclaimer, the term of this patent is extended or adjusted under 35 U.S.C. 154(b) by 0 days.

(21) Appl. No.: 09/670,293

(22) Filed: Sep. 25, 2000

(51) Int. Cl.[7] ..... H05B 1/02

(52) U.S. Cl. ..... 219/481; 219/497; 4/541.1; 392/441; 340/618

(58) Field of Search ..... 219/497, 496, 219/501, 505, 481; 4/541.1; 392/441; 73/294, 304 R; 340/612, 618

(56) References Cited

U.S. PATENT DOCUMENTS 5,079,784 A * 1/1992 Rist et al. ..... 4/542
5,361,215 A * 11/1994 Tompkins et al. ..... 364/505
5,590,532 A * 1/1997 Bachman ..... 62/2.3
6,223,595 B1 * 5/2001 Dumbovic et al. ..... 73/295

* cited by examiner

*Primary Examiner*—Mark Paschall
(74) *Attorney, Agent, or Firm*—John R. Ross; John R. Ross, III

(57) ABSTRACT

A dry fire protection system for a spa and the spa's associated equipment. A heating element heats the spa's water. A resistive water level sensor senses that the level of water around the heating element is higher than a predetermined height or lower than a predetermined height, and a heating element deactivation device electrically deactivates the heating element when the water level around the heating element falls below a predetermined level. In a preferred embodiment, the heating element deactivation device is an electric circuit comprising a comparator circuit and a control circuit.

10 Claims, 10 Drawing Sheets

1B
1
WATER PUMP
4
AIR BLOWER
J
J
J
J
J
J
J
D
D
D
SPA TUB
2
11
13
TS
112

KEYPAD
200
51A
COMP CKT
CTRL CKT
52A
PRIOR ART
17A
17B
7
SPA CONTROLLER (CPU)
TO WATER PUMPS
TO AIR BLOWER
111
53A
54
50
TS
71
S
5
70
S
WATER PUMP
WPS
1A
3
15

RESISTIVE WATER SENSOR FOR HOT TUB SPA HEATING ELEMENT

BACKGROUND OF THE INVENTION

A spa (also commonly known as a "hot tub" when located outdoors) is a therapeutic bath in which all or part of the body is exposed to forceful whirling currents of hot water. When located indoors and equipped with fill and drain features like a bathtub, the spa is typically referred to as a "whirlpool bath". Typically, the spa's hot water is generated when water contacts a heating element in a water circulating heating pipe system. A major problem associated with the spa's water circulating heating pipe system is the risk of damage to the heater and adjacent parts of the spa when the heater becomes too hot.

FIG. 1 is a drawing showing the main elements of a prior art hot tub spa system 1. Spa controller 7 is programmed to control the spa's water pumps 1A and 1B and air blower 4. In normal operation, water is pumped by water pump 1A through heater 3 where it is heated by heating element 5. The heated water then leaves heater 3 and enters spa tub 2 through jets 11. Water leaves spa tub 2 through drains 13 and the cycle is repeated.

Some conditions may cause little or no flow of water through the pipe containing heating element 5 during the heating process. These problems can cause what is known in the spa industry as a "dry fire". Dry fires occur when there is no water in heater 3 or when the flow of water is too weak to remove enough heat from the heating element 5. Common causes of low water flow are a dirty filter or a clogged pipe. For example, referring to FIG. 1, if a bathing suit became lodged in pipe 17B clogging the pipe, flow of water through heater 3 would be impeded and a dry fire could occur.

KNOWN SAFETY DEVICES

FIG. 1 shows a prior art arrangement to prevent overheating conditions. A circuit incorporating temperature sensor 50 serves to protect spa 1 from overheating. Temperature sensor 50 is mounted to the outside of heater 3. Temperature sensor 50 is electrically connected to comparator circuit 51A and control circuit 52A, which is electrically connected to high limit relay 53A.

As shown in FIG. 1, power plug 54 connects heating element 5 to a suitable power source, such as a standard household electric circuit. Water inside heater 3 is heated by heating element 5. Due to thermal conductivity the outside of heater 3 becomes hotter as water inside heater 3 is heated by heating element 5 so that the outside surface of heater 3 is approximately equal to the temperature of the water inside heater 3. This outside surface temperature is monitored by temperature sensor 50. Temperature sensor 50 sends an electric signal to comparator circuit 51A corresponding to the temperature it senses. When an upper end limit temperature limit is reached, such as about 120 degrees Fahrenheit, positive voltage is removed from the high temperature limit relay 53A, and power to heating element 5 is interrupted.

A detailed view of comparator circuit 51A and control circuit 52A is shown in FIG. 4. Temperature sensor 50 provides a signal representing the temperature at the surface of heater 3 to one input terminal of comparator 60. The other input terminal of comparator 60 receives a reference signal adjusted to correspond with a selected high temperature limit for the surface of heater 3. As long as the actual temperature of the surface of heater 3 is less than the high temperature limit, comparator 60 produces a positive or higher output signal that is inverted by inverter 62 to a low or negative signal. The inverter output is coupled in parallel to the base of NPN transistor switch 64, and through a normally open high limit reset switch 66 to the base of a PNP transistor switch 68. The low signal input to NPN transistor switch 64 is insufficient to place that switch in an "on" state, such that electrical power is not coupled to a first coil 70 of a twin-coil latching relay 74. As a result, the switch arm 76 of the latching relay 74 couples a positive voltage to control circuit 52A output line 78 which maintains high limit relay 53A in a closed position (FIG. 1).

As shown in FIG. 4, in the event the switch arm 76 of the latching relay 74 is not already in a position coupling the positive voltage to the output line 78, momentary depression of the high limit reset switch 66 couples the low signal to the base of PNP transistor switch 68, resulting in energization of a second coil 72 to draw the switch arm 76 to the normal power-on position.

If the water temperature increases to a level exceeding the preset upper limit, then the output of the comparator 60 is a negative signal which, after inversion by the inverter 62, becomes a high signal connected to the base of NPN transistor switch 64. This high signal switches NPN transistor switch 64 to an "on" state, and thus energizes the first coil 70 of latching relay 74 for purposes of moving the relay switch arm 76 to a power-off position. Thus, the positive voltage is removed from the high temperature limit relay 53A, and power to heating element 5 is interrupted. Subsequent depression of the high limit reset switch 66 for resumed system operation is effective to return switch arm 76 to the power-on position only if the temperature at the surface of heater 3 has fallen to a level below the upper limit setting.

In addition to the circuit incorporating temperature sensor 50, it is an Underwriters Laboratory (UL) requirement that there be a separate sensor located inside heater 3 in order to prevent dry fire conditions. There are currently two major types of sensors that are mounted inside of heater 3: water pressure sensors and water flow sensors.

Water Pressure Sensor

FIG. 1 shows water pressure sensor 15 mounted outside heater 3. As shown in FIG. 1, water pressure sensor 15 is located in a circuit separate from temperature sensor 50. It is electrically connected to spa controller 7, which is electrically connected to regulation relay 111.

Tub Temperature Sensor

Spa controller 7 also receives an input from tub temperature sensor 112. A user of spa 1 can set the desired temperature of the water inside tub 2 to a predetermined level from keypad 200. When the temperature of the water inside tub 2 reaches the predetermined level, spa controller 7 is programmed to remove the voltage to regulation relay 111, and power to heating element 5 will be interrupted.

Operation of Water Pressure Sensor

In normal operation, when water pressure sensor 15 reaches a specific level, the electromechanical switch of the sensor changes its state. This new switch state indicates that the water pressure inside heater 3 is large enough to permit the heating process without the risk of dry fire. Likewise, in a fashion similar to that described for temperature sensor 50, when a lower end limit pressure limit is reached, such as about 1.5–2.0 psi, positive voltage is removed from regulation relay 111, and power to heating element 5 is interrupted.

However, there are major problems associated with water pressure sensors. For example, due to rust corrosion, these devices frequently experience obstruction of their switch mechanism either in the closed or open state. Another problem is related to the poor accuracy and the time drift of the pressure sensor adjustment mechanism. Also, water pressure sensors may have leaking diaphragms, which can lead to sensor failure. The above problems inevitably add to the overall expense of the system because they may require relatively frequent replacement and/or calibration of water pressure sensor switch.

Water Flow Sensor

Another known solution to the dry fire problem is the installation of a water flow sensor 16 into the heating pipe, as shown in FIG. 2. However, like the water pressure sensor, water flow sensor 16 is prone to mechanical failure in either the open or close state. Moreover, water flow sensor switches are expensive (approximately $12 per switch) and relatively difficult to mount.

Microprocessor Utilization

It is known in the prior art that it is possible to substitute a microprocessor in place of the comparator circuit and control circuit, as shown in FIG. 3. Microprocessor 56A is programmed to serve the same function as comparator circuit 51A and control circuit 52A (FIG. 1). When an upper end limit temperature limit is reached, such as about 120 degrees Fahrenheit, microprocessor 56A is programmed to cause positive voltage to be removed from high temperature limit relay 53A, and power to heating element 5 is interrupted.

Resistive Water Level Sensor

Resistive water level sensors (also known as resistive fluid level sensors) are known. A resistive water level sensor functions by utilizing a probe to sense the presence or absence of water in a water container. FIGS. 8A and 8B illustrate the operation of a resistive water level sensor. FIG. 8B shows water 204 in container 203. Electrically conductive probe 201 is held in place inside container 203 by insulating sleeve 200. A conductive wire extends from the top of probe 201 to electronic circuit 206. Conductor 202 is mounted to the side of container 203 and is grounded. As shown in FIG. 8B, the water level is below probe 201. Therefore the resistance between probe 201 and conductor 202 is substantially infinite. Hence, no current would flow through the electronic circuit. In FIG. 8A, the water level has increased so that it is above the tip of probe 201. The resistance through water 204 is relatively low and a current carrying path is established between probe 201 and conductor 202, completing the electronic circuit.

A popular application of resistive water level sensors is their utilization to sense to presence or absence of boiler water in heating plant boilers. Advantages of resistive water level sensors are that they have a relatively simple design, requiring low maintenance and are relatively inexpensive.

What is needed is a better device for preventing dry fire conditions in a hot tub spa.

SUMMARY OF THE INVENTION

The present invention provides a dry fire protection system for a spa and the spa's associated equipment. A heating element heats the spa's water. A resistive water level sensor senses that the level of water around the heating element is higher than a predetermined height or lower than a predetermined height, and a heating element deactivation device electrically deactivates the heating element when the water level around the heating element falls below a predetermined level. In a preferred embodiment, the heating element deactivation device is an electric circuit comprising a comparator circuit and a control circuit.

DETAILED DESCRIPTION OF THE PREFERRED EMBODIMENT

Figure 1:
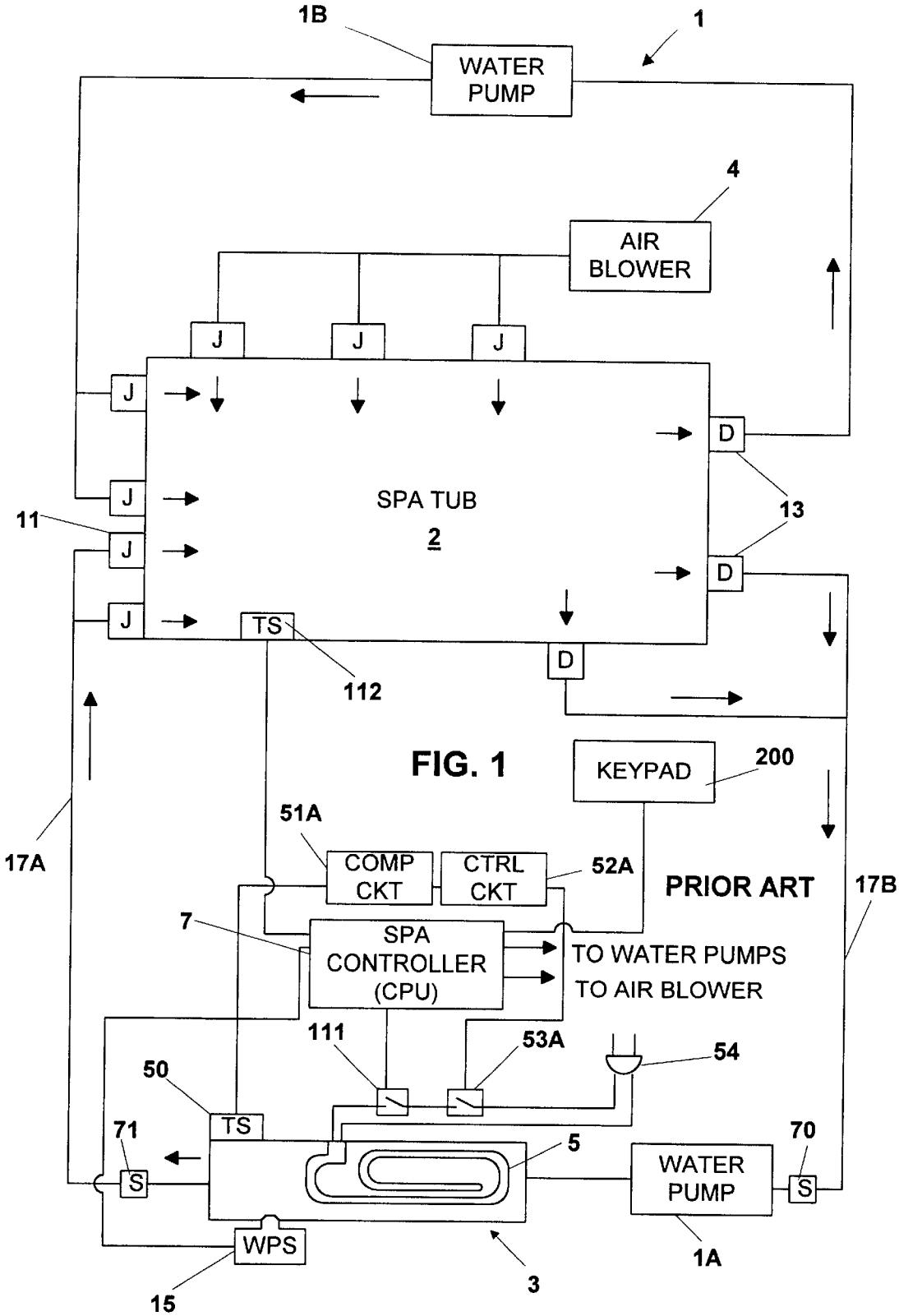
FIG. 1 shows a prior art hot tub spa utilizing a water pressure sensor.
Figure 2:
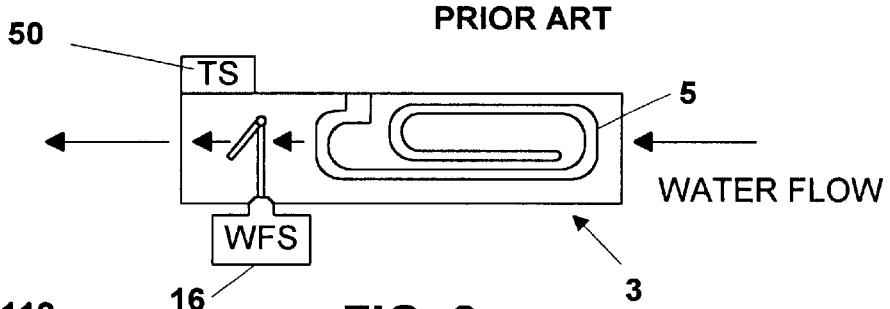
FIG. 2 shows a prior art heater utilizing a water flow sensor.
Figure 3:
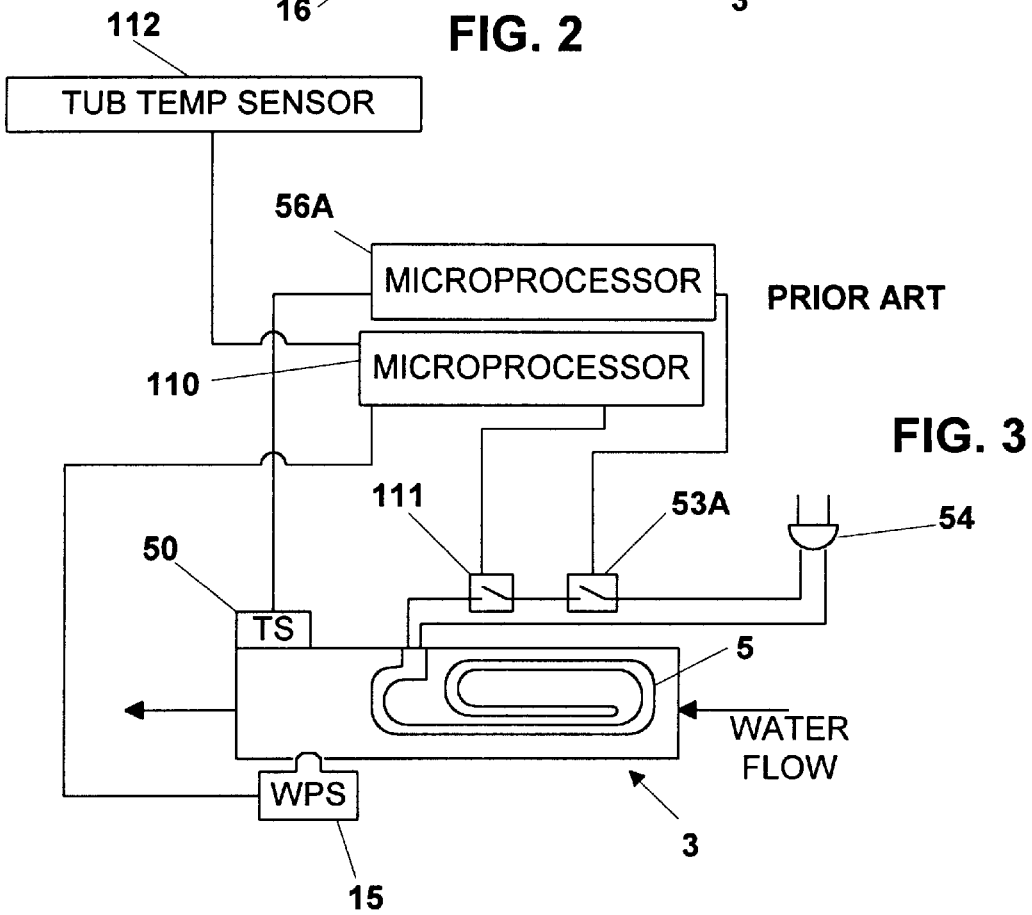
FIG. 3 shows a prior art utilization of a microprocessor.
Figure 4:
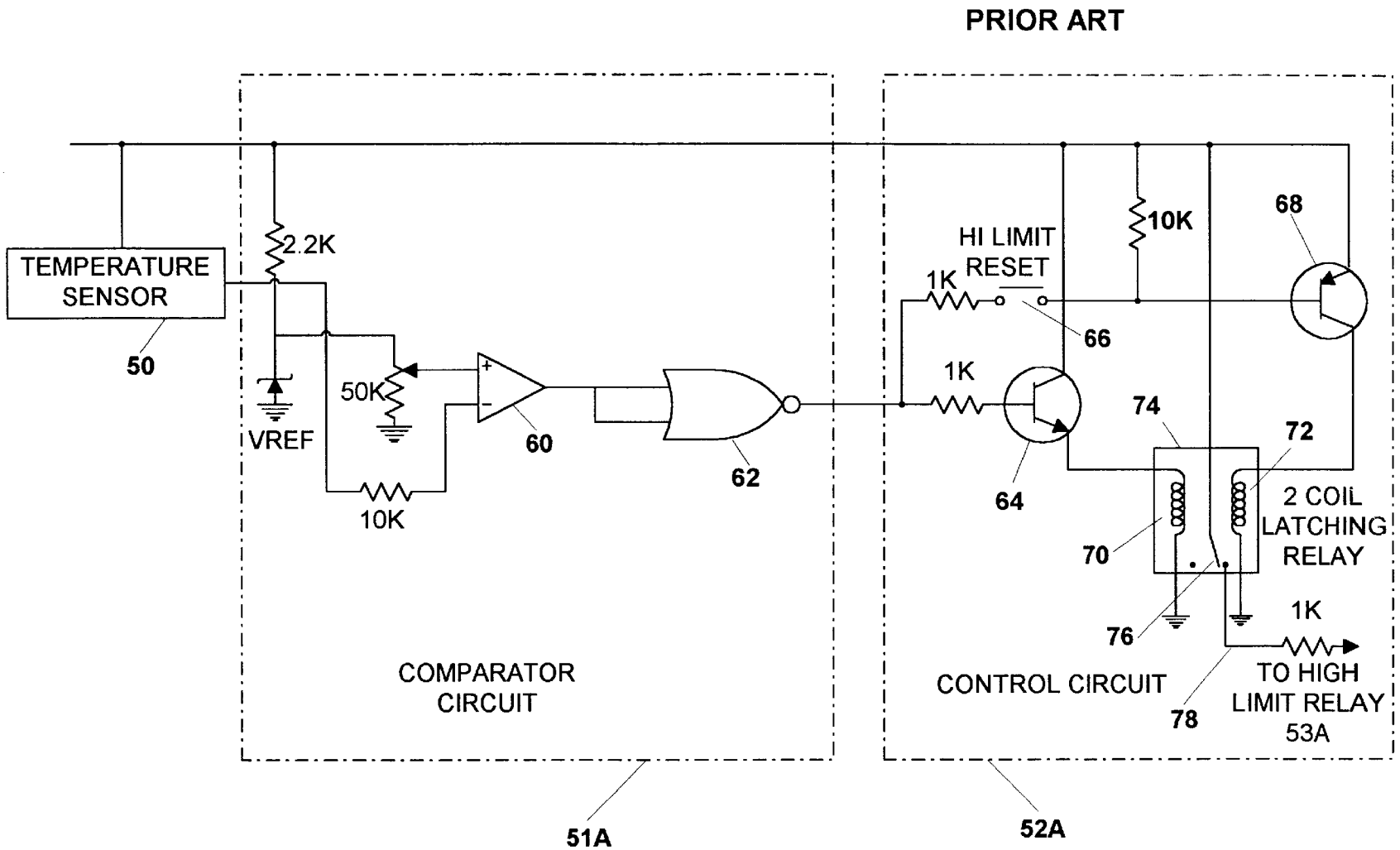
FIG. 4 shows a prior art circuit comprising a comparator circuit and a control circuit.

A detailed description preferred embodiments of the present invention can be seen by reference to FIGS. 5–13.

Protection Against a Dry Fire Condition

The present invention provides protection against a dry fire condition. A dry fire can occur if heating element 5 is on and there is no water or very little water inside heater 5 to remove heat from heating element 5. A cause of a low or no water condition inside heater 3 could be blockage in pipe 17B or in drains 13 or a closed slice valve 70. Also, evaporation of water from spa tub 2 could cause a low water condition inside heater 3, leading to a dry fire. If there is no water or only a small amount of water inside heater 3 so that the level of the water does not reach the tip of probe 250, the resistance between between probe 250 and conductor 251 will be substantially infinite. Then, positive voltage will be removed from regulation relay 53B, and power to heating element 5 will be interrupted.

Preferred Embodiment

Figure 5:
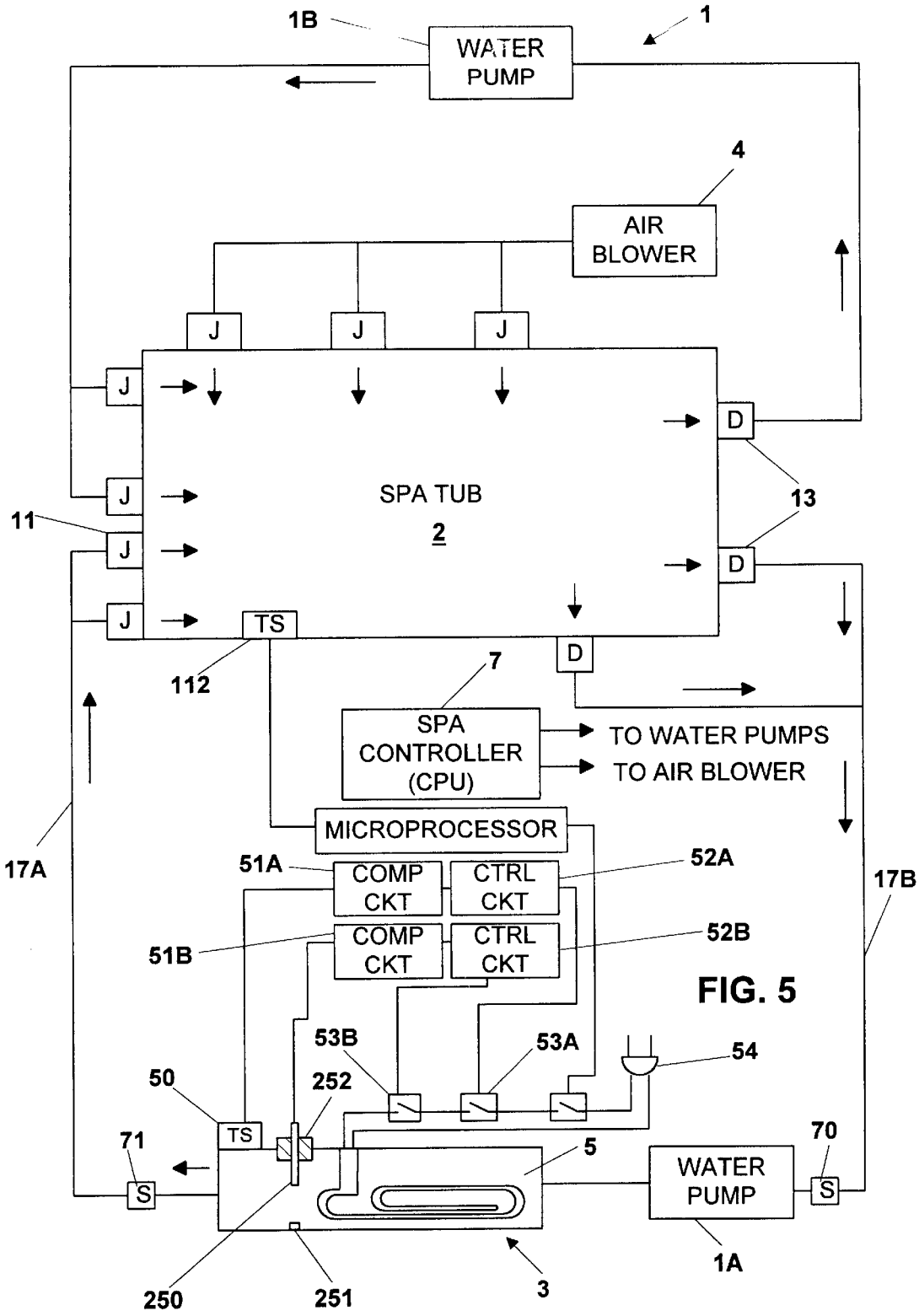
FIG. 5 shows a hot tub spa utilizing a preferred embodiment of the present invention.

In a preferred embodiment, resistive water level sensor probe 250 is a stainless steel pin, as shown in FIG. 5. Probe 250 is mounted inside insulating enclosure 252. Insulating enclosure 252 serves as a holder to maintain the probe in place inside heater 3. Conductor 251 is mounted to the inside of heater 3. The resistance measurement between probe 250 and conductor 251 is used to determine if the level of water is adequate around heating element 5.

Probe 250 is part of an electrical circuit that includes comparator circuit 51B, control circuit 52B, and regulation relay 53B. When the resistance between probe 250 and conductor 251 is greater than a predetermined limit level, control circuit 52B causes positive voltage to be removed from regulation relay 53B, and power to heating element 5 will be interrupted. In a preferred embodiment, the predetermined limit level is approximately 3.75 MΩ. For example, if the water level inside heater 3 is such that it does not reach the tip of probe 250, then there will be substantially infinite resistance between the tip of probe 250 and conductor 251. This resistance would be greater than the predetermined limit level and power to heating element 5 would therefore be interrupted.

Whirlpool Bath Application

Although the above preferred embodiment discussed utilizing the present invention with spas that do not incorporate separate fill and drain devices, those of ordinary skill in the art will recognize that it is possible to utilize the present invention with spas that have separate fill and drain devices, commonly known as whirlpool baths.

Figure 7:
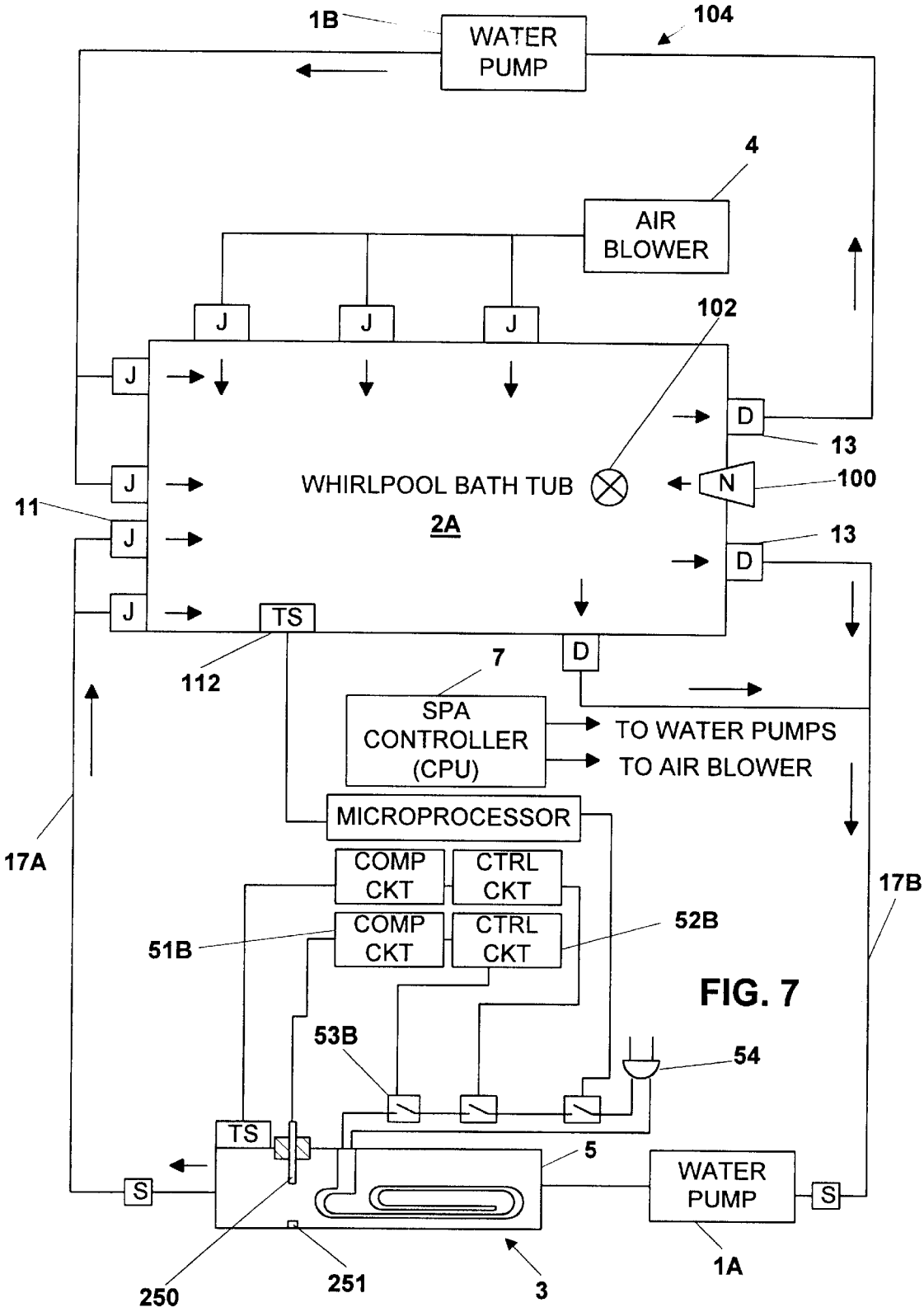
FIG. 7 shows another preferred embodiment of the present invention.
Figure 8B:
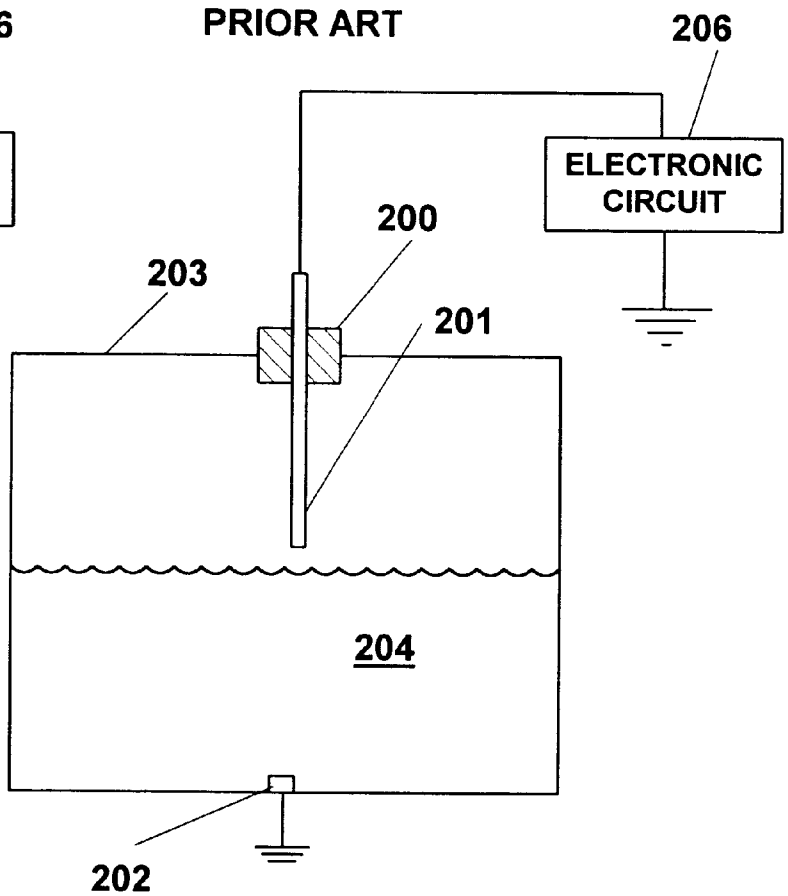
FIGS. 8A and 8B show the operation of a resistive water level sensor.
Figure 8A:
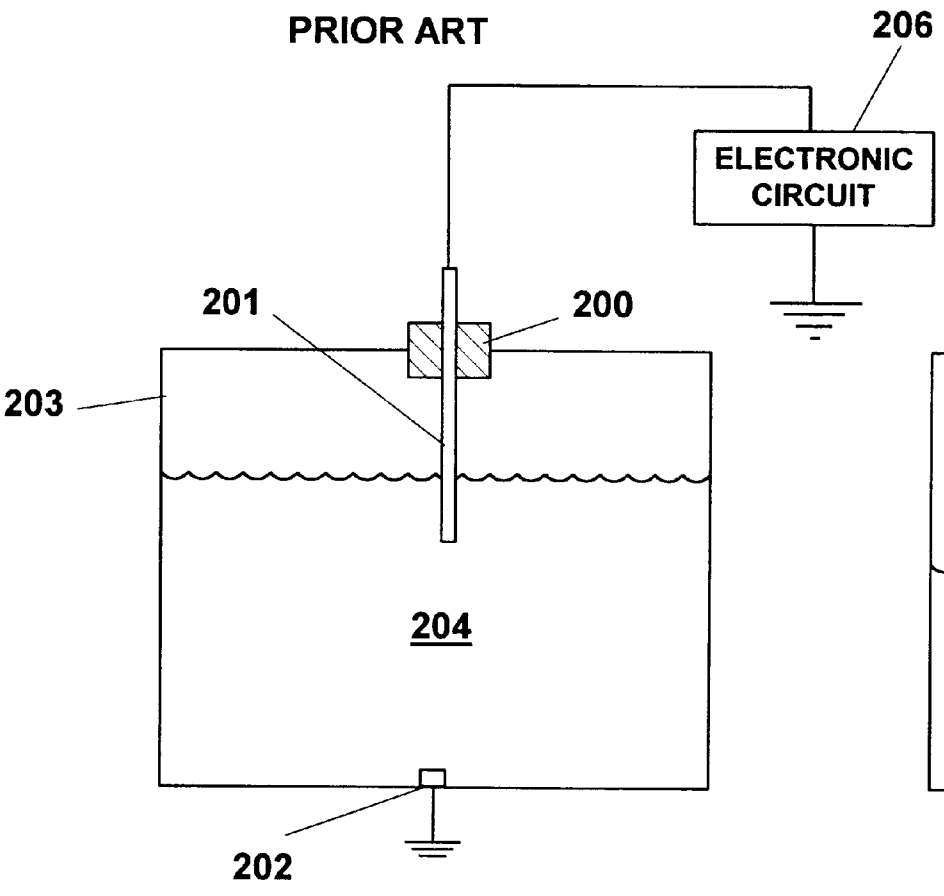

A whirlpool bath is usually found indoors. Like a common bathtub, a whirlpool bath is usually filled just prior to use and drained soon after use. As shown in FIG. 7, tub 2A is filled with water prior to use via nozzle 100 and drained after use via tub drain 102. Once tub 2A is filled, whirlpool bath 104 operates in a fashion similar to that described for spa 1. Spa controller 7 is programmed to control the whirlpool bath's water pumps 1A and 1B and air blower 4. In normal operation, water is pumped by water pump 1A through heater 3 where it is heated by heating element 5. The heated water then leaves heater 3 and enters spa tub 2 through jets 11. Water leaves spa tub 2 through drains 13 and the cycle is repeated.

When the resistance between probe 250 and conductor 251 is greater than a predetermined limit level, control circuit 52B causes positive voltage to be removed from regulation relay 53B, and power to heating element 5 will be interrupted. For example, if the water level inside heater 3 is such that it does not reach the tip of probe 250, then there will be substantially infinite resistance between the tip of probe 250 and conductor 251. This resistance would be greater than the predetermined limit level and power to heating element 5 would therefore be interrupted.

Figure 13:
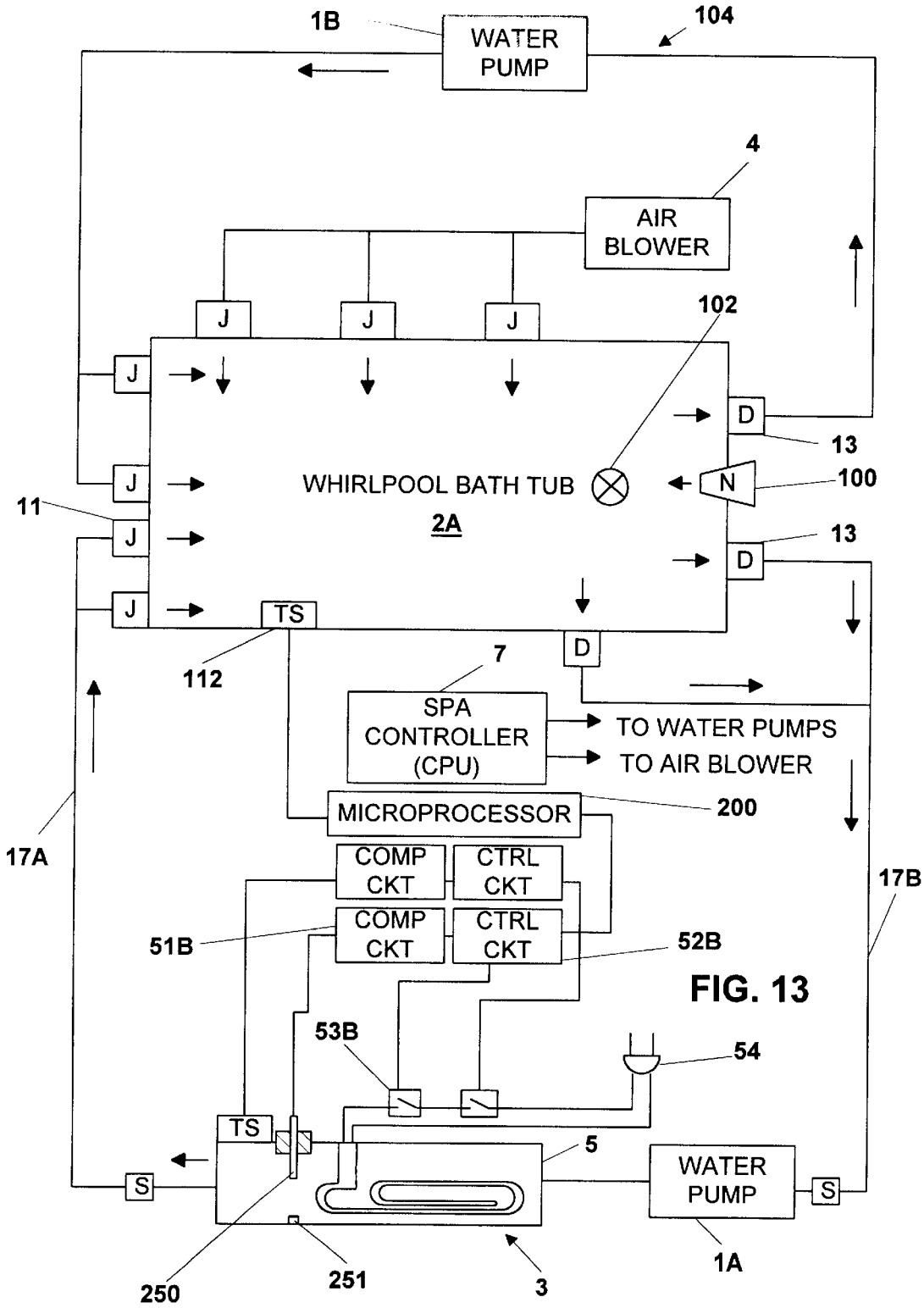
FIG. 13 shows another preferred embodiment of the present invention.

FIG. 13 shows another preferred embodiment of the present invention in which signals from both microprocessor 200 and probe 250 are used to control regulation relay 53B

Heater Pipe Embodiments

Figure 11:
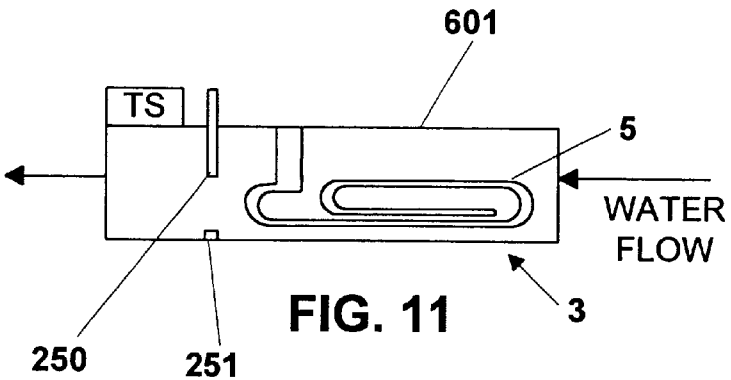
FIGS. 10–12 show preferred embodiments of the present invention.
Figure 10:
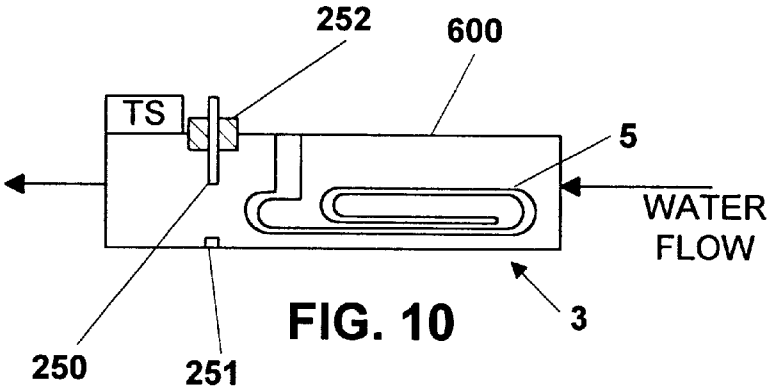
Figure 12:
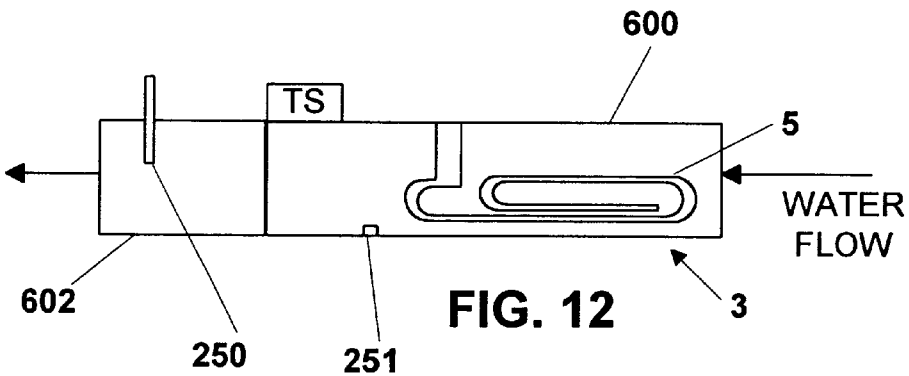

FIG. 10 shows a preferred embodiment of heater 3 in which heater pipe 600 is metal. Probe 250 is mounted to heater pipe 600 by insulating enclosure 252. Ideally, when the water level inside heater 3 reaches the tip of probe 250, current will flow from probe 250 to the side of metal heater pipe 600 and then leave through conductor 251. When the water level is below the tip of probe 250, no significant current should flow. However, it is possible due to condensation on the surface of insulating enclosure 252 inside heater 3, for current to flow from probe 250 across insulating enclosure 252 to the side of metal heater 600 prior to the water level reaching the tip of probe 250, thereby causing a false reading. Utilizing the embodiments shown in FIG. 11 or 12 can eliminate this risk. FIG. 11 shows probe 250 mounted inside plastic heater pipe 601. In this embodiment by making the heater pipe out of non-conducting plastic, the path to ground is drastically increased. Hence, the risk of a false read due to condensation is lessened. FIG. 12 shows metal pipe 600 with plastic fitting 602 attached to its end. In this embodiment, the amount of metal around probe 250 has also been decreased, decreasing the risk of a false read due to condensation.

Microprocessor Embodiments

Figure 6:
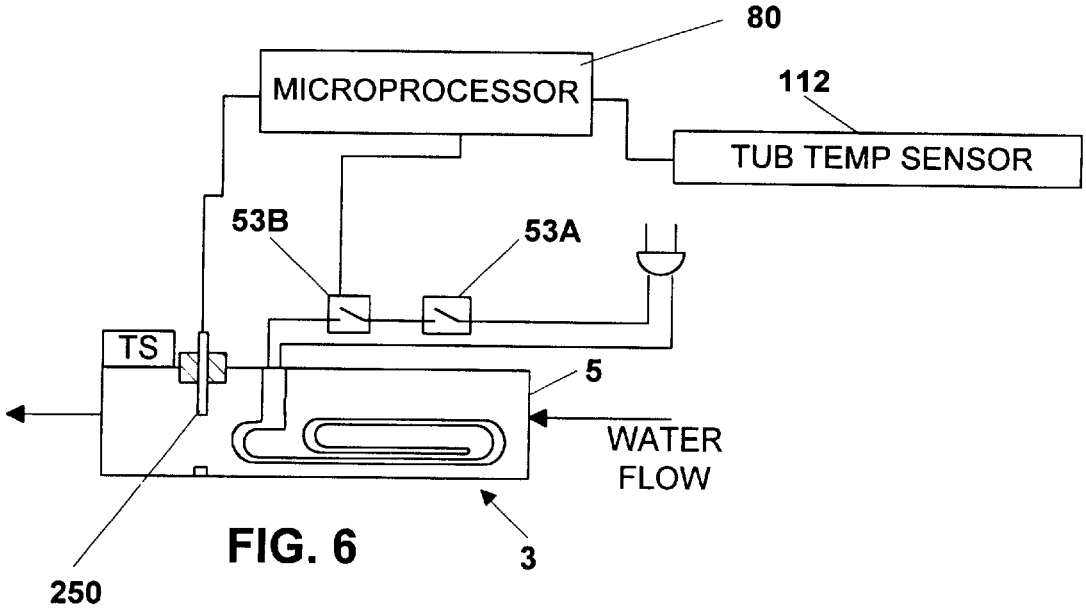
FIG. 6 shows another preferred embodiment of the present invention.
Figure 9:
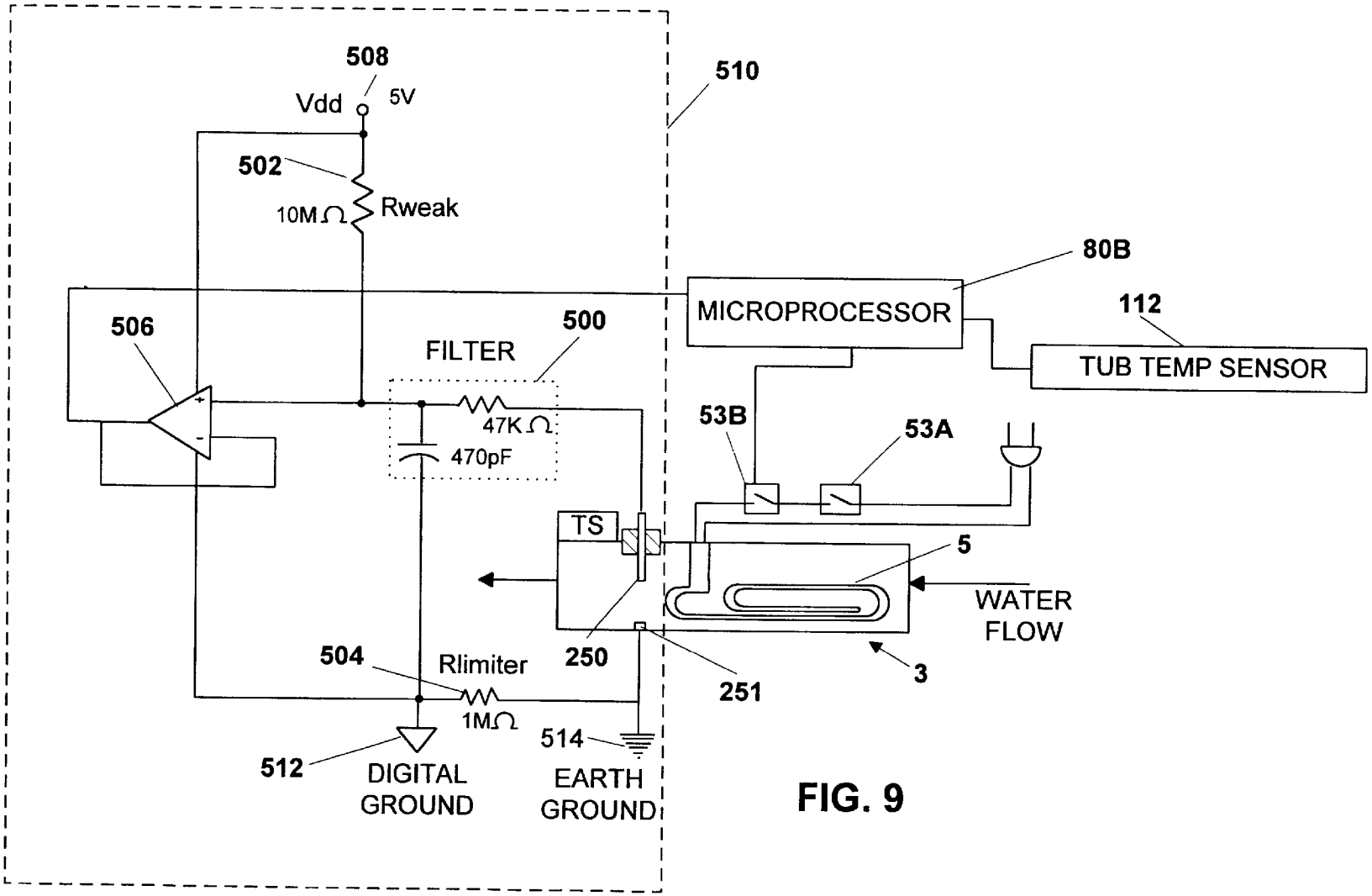
FIG. 9 shows another preferred embodiment of the present invention.

FIG. 6 shows probe 250 as part of an electric circuit that includes microprocessor 80 in place of comparator circuit 51B and control circuit 52B. In this preferred embodiment, microprocessor 80 also receives input from tub temperature sensor 112. Microprocessor 80 controls regulation relay 53B. FIG. 9 shows another preferred embodiment that includes circuit 510 and microprocessor 80B. In this preferred embodiment, voltage from DC voltage source 508 feeds op-amp 506. Filter 500 is inserted in the circuit to protect the circuit against noise and ESD. Current limiting resistor, Rlimiter 504, has a much lower value than Rweak 502 and is placed between earth ground 514 and digital ground 512. If there is no water in heater 5, the resistance between probe 250 and conductor 251 is substantially infinite. So, there is no current through Rweak 502 and the voltage drop across Rweak 502 is approximately 0V. Consequently, the input voltage at op-amp 506 is approximately 5 Volt and the op-amp output voltage is also approximately 5 Volt. When there is water in heater 3 between probe 250 and conductor 251 a current path is set up that flows through filter 500 through the water in heater 3, through Rlimiter 504, to digital ground 512. This current path creates a voltage drop between the Rweak 502 terminal. As a result, the input signal to op-amp 506 and the output signal from op-amp 506 are both decreased to a voltage level between 0 to 2.5 Volt. Microprocessor 80B is programmed to make a determination based on the signal coming from op-amp 506 whether or not there is sufficient water inside heater 3. If the level of water is insufficient inside heater 3, then positive voltage will be removed from regulation relay 53B, and power to heating element 5 will be interrupted.

Although the above-preferred embodiments have been described with specificity, persons skilled in this art will recognize that many changes to the specific embodiments disclosed above could be made without departing from the spirit of the invention. Therefore, the attached claims and their legal equivalents should determine the scope of the invention.

We claim:

1. A dry fire protection system for a spa, comprising:

A. a heating element for heating the water contained in a water heater, the water defining a water level in said water heater, B. a resistive water level sensor for monitoring the water level, C. a heating element deactivation device for deactivating said heating element, wherein said heating element, said resistive water level sensor and said deactivation device are arranged in a deactivation circuit such that said deactivation device deactivates said heating element when a signal from said water level sensor indicates that the water level has fallen below a predetermined level.

2. The dry fire protection system as in claim 1, wherein said deactivation circuit comprises:

A. a comparator circuit, and

B. a control circuit.

3. The dry fire protection system as in claim 1, wherein said deactivation circuit is a microprocessor programmed to deactivate said heating element if said water level sensor detects a resistance greater than a predetermined high limit value.

4. The dry fire protection system as in claim 1, wherein said deactivation circuit is arranged such that said deactivation of said heating element occurs when said water level sensor detects a resistance greater than a predetermined high limit value.

5. The dry fire protection system as in claim 1, wherein the spa is a whirlpool bath comprising separate fill and drain devices.

6. A dry fire protection system for a spa, comprising:

A. a heating means for heating the water contained in a water heater, the water defining a water level in said water heater, B. a water level sensor means for monitoring the water level, C. a heat deactivation means for deactivating said heating means, wherein said heating means, said water level sensor means and said heat deactivation means are arranged in a deactivation circuit such that said heat deactivation means deactivates said heating means when a signal from said water level sensor means indicates that the water level has fallen below a predetermined level.

7. The dry fire protection system as in claim 6, wherein said heat deactivation means comprises:

A. a comparator circuit, and

B. a control circuit.

8. The dry fire protection system as in claim 6, wherein said heat deactivation means is a microprocessor programmed to deactivate said heating means if said water level sensor means detects a resistance greater than a predetermined high limit value.

9. The dry fire protection system as in claim 6, wherein said heat deactivation means is arranged such that said deactivation of said heating means occurs when said water level sensor means detects a resistance greater than a predetermined high limit value.

10. The dry fire protection system as in claim 6, wherein the spa is a whirlpool bath comprising separate fill and drain devices.

* * * * *